US005411352A

United States Patent [19]

Eren

[11] Patent Number: 5,411,352

[45] Date of Patent: May 2, 1995

[54] LAMINATED SPORTS FLOOR AND METHOD OF MAKING THE SAME

[76] Inventor: Tumer H. Eren, 28 Leavenworth St., Woodbury, Conn. 06798

[21] Appl. No.: 216,444

[22] Filed: Mar. 23, 1994

[51] Int. Cl.[6] ..... E01C 3/00

[52] U.S. Cl. ..... 404/31; 404/32; 472/92

[58] Field of Search ..... 472/92, 85, 88, 89, 472/94; 428/95, 92, 96, 97; 404/31, 32, 28, 44; 273/29 R, 31

[56] References Cited

U.S. PATENT DOCUMENTS

| | | | |
|---|---|---|---|
| 3,801,421 | 4/1974 | Allen et al. | 161/67 |
| 3,974,312 | 8/1976 | Stevens et al. | 428/91 |
| 4,112,176 | 9/1978 | Bailey | 428/304 |
| 4,205,109 | 5/1980 | France et al. | 428/150 |
| 4,420,513 | 12/1983 | Coke et al. | 404/32 X |
| 4,523,755 | 6/1985 | Turba | 404/31 X |
| 4,606,963 | 8/1986 | Farrell | 404/27 X |
| 4,897,302 | 1/1990 | Bull | 428/95 X |
| 5,085,424 | 2/1992 | Wood, Jr. | 472/92 |
| 5,183,438 | 2/1993 | Blom | 472/92 |
| 5,286,555 | 2/1994 | Reed | 428/283 |

*Primary Examiner*—Carl D. Friedman
*Assistant Examiner*—Kien Nguyen
*Attorney, Agent, or Firm*—Lawrence Hager

[57] ABSTRACT

A laminated playing surface such as a tennis court comprises: (a) a rubber like basemat which generally is formed of rubber particles bound without pollutants, in roll form; (b) a primer generally being a mixture of adhesive and dry silica sand; a layer of sand applied while the primer is wet which bonds with and fills surface gaps, holes, ravines and gorges; (d) a coating compound of sand and acrylic; (e) and a surface color coatings.

8 Claims, 3 Drawing Sheets

LAMINATED SPORTS FLOOR AND METHOD OF MAKING THE SAME

FIELD OF THE INVENTION

The invention relates to a method and system for installing a sports playing surface and, more particularly, to a flexible anti-skid cushioned tennis court and other playing surface.

BACKGROUND OF THE INVENTION

Indoor and outdoor running surfaces formed of a layer of poured urethane elastomer which cures to a solid resilient surface, have become quite popular for athletic runways or tracts. Urethane elastomers are relatively easy to handle in liquid form at average ambient temperatures and have relatively long life and weatherability. However, untextured or solid urethane elastomer surfaces lack the surface roughness desired for running surfaces, particularly of the type used for track and field events. Accordingly, heretofore it has been the practice in the art of constructing urethane runways and the like to provide a roughened surface by broadcasting particles and granules of solid urethane onto the surface after the liquid urethane has been poured or sprayed in place to form the runway base. The broadcasting of granules or surface coatings has been unsatisfactory in that adhesion of the granules to the urethane base is incomplete and the granules eventually break free or are partially broken away from the base. Accordingly, the track or runway surface again loses its attractive characteristics and resurfacing operations must be undertaken at frequencies which are costly.

With the expansion of tennis as a participant sport, the construction of tennis courts has multiplied. Tennis courts have been constructed of many types of surfaces including grass, clay, dirt, asphalt or macadam, concrete, wood, linoleum, brick and synthetic turf. Wood and linoleum are used primarily for indoor courts. Outdoor courts are generally surfaced with concrete, asphalt or a synthetic surface.

Concrete and asphalt require very little maintenance but their initial construction costs are high. Also, the hard unyielding surfaces for the concrete and asphalt cause excessive strain on the legs and feet of players.

Clay courts are less expensive to construct than concrete or asphalt, but a clay court requires a great deal of maintenance.

Elastomeric compositions which are applied over a concrete or asphalt surface are commonly used in the new construction of tennis courts. Also, synthetic turf tennis courts have been provided.

Through direct experience with both customers and products, the following conclusions were ascertained: Most private home owners, municipalities,universities, etc. prefer hard court surfaces (asphalt or concrete) because they are basically maintenance free, and practical. Hard court surfaces have unavoidable problems over time, to wit:

most have no cushioning or resiliency and are unhealthy for the human body exposed to long hours of play. Natural elements cause cracks and uneven surfaces. Repairs for cracked hard surfaces are nearly impossible and cannot be done without expensive major structural changes. A wet laid cushion system can answer some of the resiliency needs and offer some protection from natural elements.

However, it will never be a sufficient cushion for the body during play due to it's cushion variations which is easily altered by temperature changes. Water can penetrate through the hard surfaces causing the surfaces to crack. Building hard surfaces with a full urethane system is extremely expensive and it is very difficult to adjust the urethane surface to the climate conditions. Repairing cracked surfaces with urethane layers or raising of the worn down areas on a urethane surface are extremely difficult and a construction company's worst nightmare. Many persons (schools, universities, municipalities etc.) who currently have cinder or gravel sport surfaces (running tracks, volleyball, basketball courts, etc.) have found it very difficult and expensive to convert these surfaces to hard surfaces (asphalt or concrete) and finish them with a wet laid acrylic or urethane system.

In resent years a great deal of interest has been shown in the provision of tennis and other sport surface courts having a cushioned surface. The sport surfaces currently on the market continue to frustrate both supplier and consumer with problems. The present innovative system (Maintenance Free—All Weather Surface System) will resolve the prior art problems as follows:

Old, damaged and cracked hard court surfaces (tennis, basketball, volleyball, running tracks, etc.) can be refinished without expensive, major structural changes, with a full cushion surface.

Existing cinder sport surfaces can be easily converted to a full cushion surface without major cost.

Any new sport arenas can be constructed with this new system, a full cushion surface and will be free of structural problems for many years to come.

Based on observation and experience (indoor and outdoor sport surfaces) should be:

Maintenance Free—All Weather

Practical—No preparation prior to play.

Cushioned—One of the most important elements for a sport surface. A cushioned surface will give the players an opportunity to enjoy the sport for many years to come without causing or contributing to health problems.

Inexpensive—It should be affordable for everyone (private home owners, municipalities, schools, sport clubs, etc.).

Durability—It should not be affected by weather, and be easily and inexpensively maintained.

Versatility—May be used for a variety of sports and can be installed on different surfaces (asphalt, concrete, wood, cinder, etc.).

This invention known as "CLASSIC TURF" will be able to answer all of the above mentioned needs for different kinds of sports and different types of surfaces. "CLASSIC TURF" (All Weather Surface System Layers) basically includes the following elements:

1. SBR Basemat
2. Primer
3. Grip
4. Leveler-Filler Coating
5. Texture Coating
6. Color Coating
7. Playing Lines

PRIOR ART STATEMENT

A known method of installing a sporting surface for tennis courts is described in U.S. Pat. No. 4,897,302 issued Jan. 30, 1990 to Paul F. Bull. According to the method disclosed in this patent, a porous base layer is formed from a matrix of (wet) liquid polyurethane mixed with resilient particles.

Thus, this referenced patent is an example of the prior art wet laid cushion systems noted above, which exhibit the problems or difficulty of repairing, prone to developing cracks, and inconsistency of surface resiliency (cushioning).

Another prior art reference is U.S. Pat. No. 3,974,312 issued Aug. 10, 1976 to James Stevens, et al, which describes a tennis court surface comprising a flat, woven, fiber-glass, base sheet having upright, glass fibers protruding; a layer of resin coating about the raised glass fibers; and a backing sheet.

Yet another prior art reference of interest is U.S. Pat. No. 4,420,513 issued Dec. 13, 1983 to Harry E. Coke, et al. This patent describes a surface having a layer of urethane elastomer with encapsulated granules of elastomeric material for runner traction.

Other prior art patents of interest include: U.S. Pat. Nos.: 5,286,555 issued Feb. 15, 1994 to William C. Reed; U.S. Pat. No. 5,183,438 issued Feb. 2, 1993 to Jan Bloom; U.S. Pat. No. 5,085,424 issued Feb. 4, 1992 to Sidney B. Wood, Jr.; U.S. Pat. No. 4,606,963 issued Aug. 19, 1986 to Dominica L. Farewell; U.S. Pat. No. 4,523,755 issued Jun. 18, 1985 to Egos Turban; U.S. Pat. No. 4,205,109 issued May 27, 1980 to Jerry France et al; U.S. Pat. No. 3,801,421 issued Apr. 2, 1974 to Michael George Allen et al; and U.S. 4,112,176 issued Sep. 5, 1978 to Allen R. Balled.

These patents are mentioned as being representative of the prior art and other pertinent references may exist. None of the above cited patents are deemed to affect the patentability of the present claimed invention.

In contrast to the prior art, the present invention provides a sport or tennis court having a robust yet cushioned surface which is relatively inexpensive to both install and repair, and combines the advantages of virtual maintenance free all weather affordable courts. Sections of the court may be cut out, a new section installed and a new surface painting applied using a minimum of steps and material at relatively less cost than prior art courts, while providing a virtually undetectable repair from the original court surface.

Thus, the present invention involves a novel combination of features combined in such a way as to afford a very efficient, relatively low cost solution to the difficulties and problems encountered with the prior art, as will become apparent as the description of the present invention proceeds.

SUMMARY OF THE INVENTION

Generally speaking, in accordance with the invention, a method of fabricating a sports or tennis court, tracks and the like comprising:

installing a prefabricated rubber like basemat uniformly over the court area;

applying a coating atop said basemat generally consisting of a mixture of urethane based sub-floor and construction adhesive with silica sand to fill in any fissures between the rubber particles in the basemat and to increase tensile strength and rigidity of the basemat;

spraying sand over the wet and tacky adhesive coating and left to dry and cure over a selected time period;

removing any excess and not bonded sand from the sprayed surface of the basemat;

applying a layer of sand filled acrylic latex compound, Non-pigmented concentrate over the previously cured laminate coating to give a desired surface toughness;

applying one or more color coatings.

The invention also provides a new and improved tennis court, in combination, comprising:

a prefabricated basemat, for example, made of recycled rubber particles bound together with polyurethane in roll or tile form;

a first laminate coating consisting of a mixture of urethane based adhesive and dry silica sand to form a bond with and fill in any fissures in the surface of said basemat whereby a hardened grit like top surface is provided;

one or more separately applied laminate filler coatings consisting of a mixture of sand and acrylic latex compound generally applied with a squeegee;

one or more surface color coatings which do not contain any sand or texture ingredient;

one or more color playing lines applied atop a portion of said color coating.

An indoor or outdoor sports surface such as a running track or basketball court or gymnasium in combination, comprising:

a subsurface or existing base such as asphalt or concrete or wood, etc. generally comprising an existing sports surface being upgraded or renovated;

an SBR basemat prefabricated generally from recycled rubber particles (for example tires) which are bounded together with polyurethane;

a primer coating atop the surface of said basemat, which consists of two parts of #60 Dry Silica Sand and ten parts of a urethane-based adhesive (PL Premium #947) to fill in any fissures in said basemat surface and to increase it's tensile strength and rigidity and to substantially provide a waterproof surface on said basemat;

a grip coating of dry silica sand provided over said primer coating while wet and left to dry and cure for a desired period with any excess or lose sand removed;

a leveling coating consisting of a sand filled acrylic latex compound applied over said grip coating;

a texture coating of fine sand and acrylic latex compound over said leveling coating to effect a desired fine surface texture;

a color coating applied over said texture coating to effect a desired surface color.

OBJECTIVES OF THE INVENTION

It is the general object of the present invention to provide a new and improved surface for sporting events.

Another object of the present invention is to provide a new and improved tennis court.

Another object of the present invention is to provide a new and improved cushioned tennis court.

Another object of the present invention is to provide a new and improved flexible anti-skid cushioned tennis court and/or other playing court/field/track surface.

A further object of the present invention is to provide a new and improved laminated sports floor.

A further object of the present invention is to provide a new type sports floor having a prefabricated basemat.

A further object of the present invention is to provide a new sports floor having a laminate primer coating mixture of a urethane based sub-floor and construction adhesive and sand.

A further object of the present invention is to provide a new type sports/tennis surface having a laminate layer of sand filled acrylic latex applied over a grip coating formed on a prefabricated rubber basemat, without use of prior art water base, solvent base or urethane base adhesives on a fiber or non-woven fabric.

A further object of the present invention is to provide a new and improved sports/tennis court/surface having a fine sand filled acrylic latex laminate texture coating to effect a fine textured surface.

Yet a further object of the present invention is to provide a color coated sports/tennis court/surface without mixing the paint with sand or texture ingredients, whereby it was discovered that relatively longer maintenance free surface life is achieved.

Another object of the present invention is to provide a new and improved sports/tennis court/surface which is relatively less expensive to install and maintain.

Another object of the present invention is to provide a new and improved sports/tennis court/surface which is capable of being installed in relatively less time then hitherto.

Another object of the present invention is to provide a new and improved sports/tennis court/surface which is relatively easy to make virtually undetectable repairs.

A still further object of the present invention is to provide a new and improved sports/tennis court/surface and installation system/method for renovating existing courts, running tracks and gymnasiums and the like to provide a cushioned anti-skid surface which can be installed over an existing surface relatively quickly and inexpensively using relatively non-toxic safe to handle materials.

It is also an object of the present invention to provide a new and improved system and method for installing, maintaining and repairing sports/tennis courts.

BRIEF DESCRIPTION OF THE DRAWINGS

Other objects and advantages of the invention may be seen more clearly from the following description when viewed in conjunction with the accompanying drawings. Like numerals refer to like parts throughout.

DESCRIPTION OF THE PREFERRED EMBODIMENTS

Figure 1:
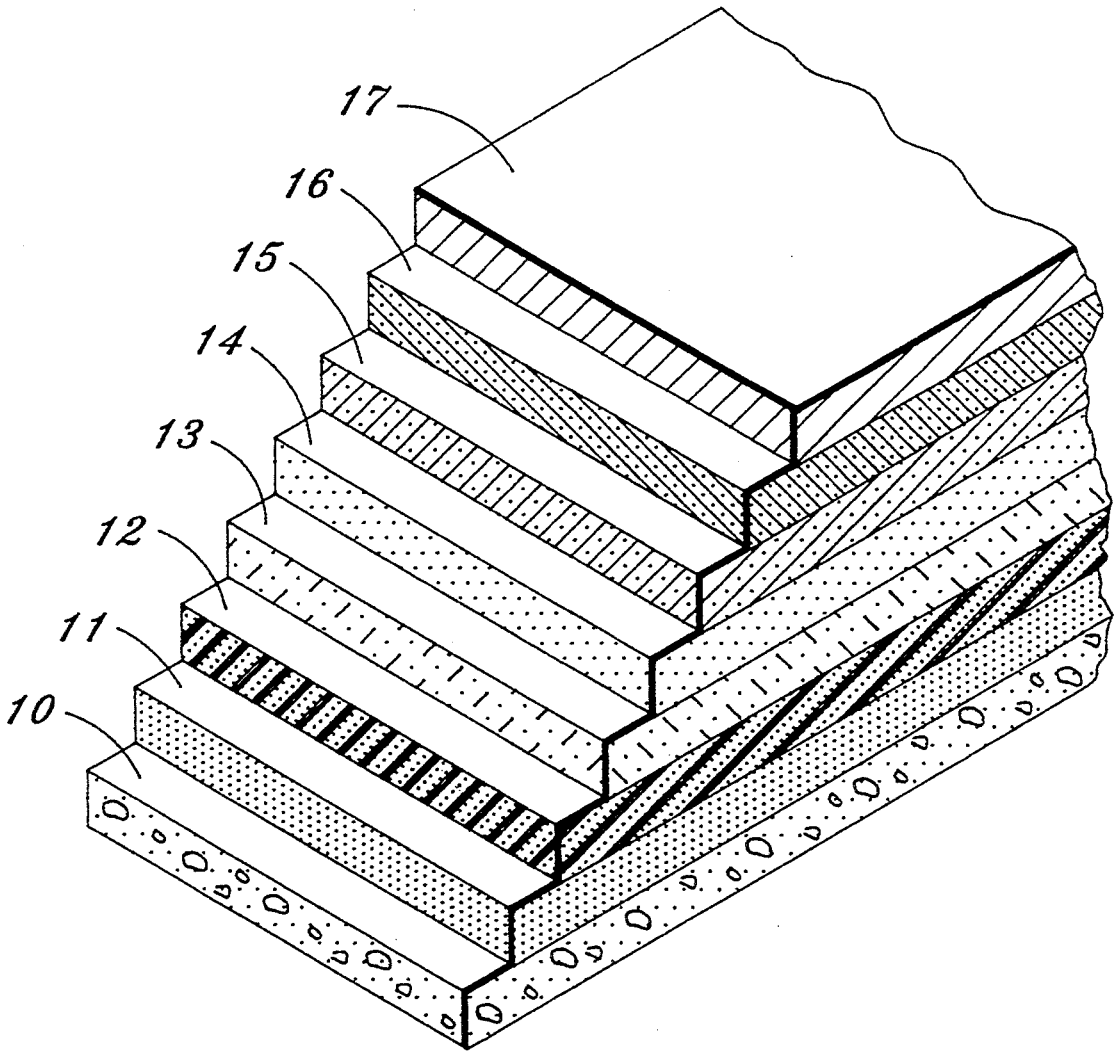
FIG.1 is a broken perspective view of a flexible anti-skid sports surface/court in accordance with the present invention.

In the past ten years or so, private tennis courts, etc., have become very popular. Aggressive court play requires an anti-skid yet flexible surface to avoid injuries.

Recently, various types of court surfaces have been proposed, all of which as noted in the prior art statement, are relatively expensive to install and maintain.

The need for a durable, all weather, inexpensive, easy to repair and maintain, yet cushioned surface court with customized (fast/slow) ball finish and being anti-skid is apparent.

It should be understood at this time that an important and advantageous feature of the present invention is the ability to readily and inexpensively install and maintain a tennis court and other sporting surfaces.

Generally speaking, the invention includes, but is not limited to, an anti-skid cushioned sports surface installed on an existing surface 10, and comprises a basemat 11, a primer coat or layer 12, a grip layer 13, a leveler coat or layer 14, a texture coat or layer 15, and a color coating 16.

Figure 2:
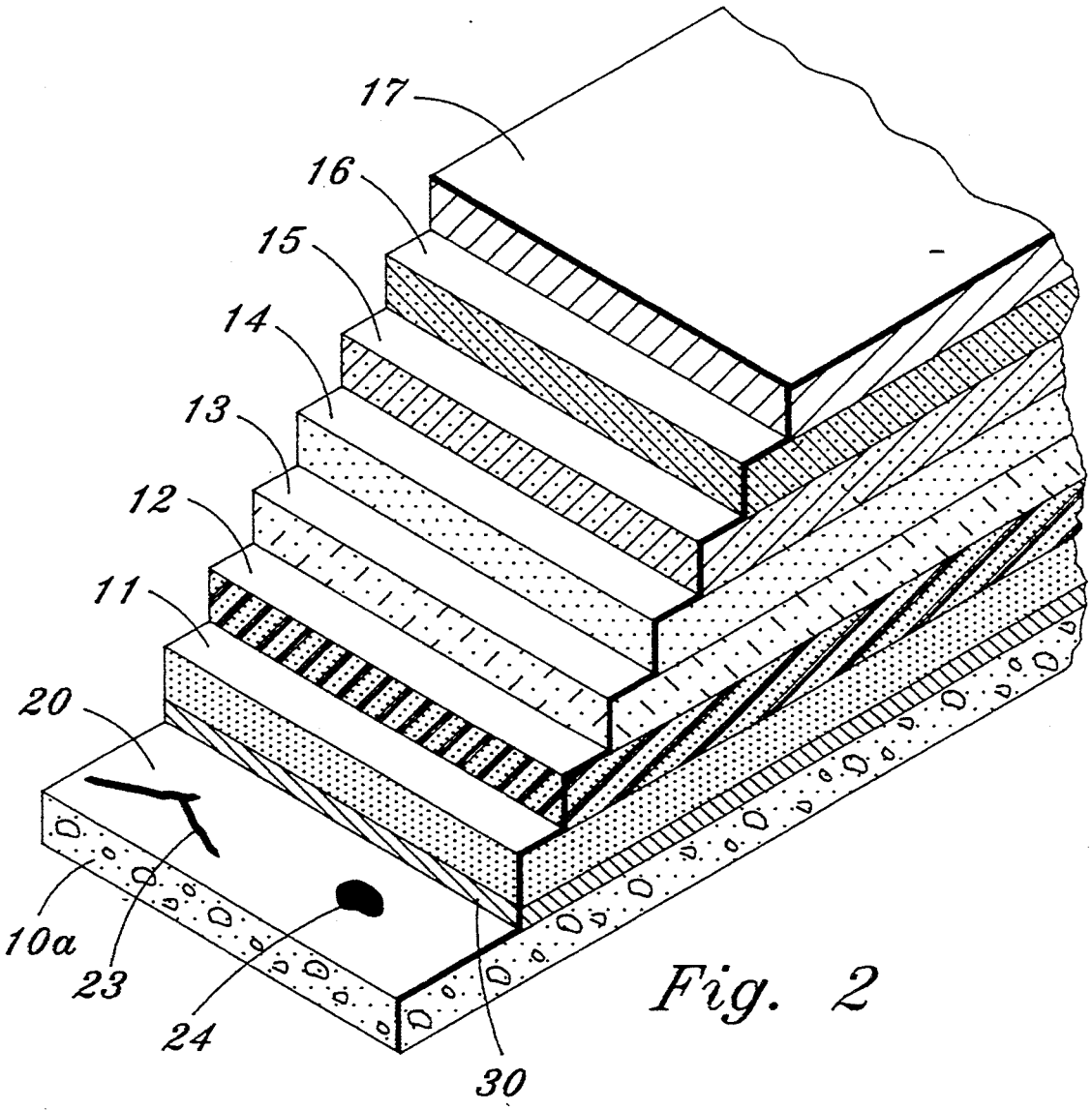
FIGS. 2 and 2A are broken perspective/illustrative views of a preferred embodiment of a method of repairing a sports floor according to the invention.
Figure 2A:
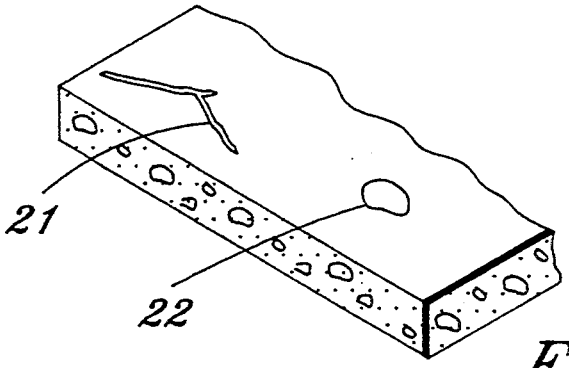

With reference now to FIGS. 1,2, and 2A, the new sports floor/surface and method of installation and renovation of an existing sports court will be described.

The base or existing surface 10 may be, for example, cinder, gravel, asphalt, wood, concrete, clay, etc. The base surface 10 may be constructed or comprise an existing tennis court, running track or gymnasium which is being resurfaced (see FIG. 2) using the present system. Any holes 21 or major cracks 22 in the base should be first filled with appropriate material for example concrete 23,24 and all loose debris removed.

The basemat 11 is pre-manufactured, generally in roll form (similar to wall-to-wall carpet) or in flat square/-rectangular sections (similar to floor tile), from rubber particles (for example, recycled SBR-rubber) mixed with and bound together by a polyurethane adhesive. The basemat 11 is engineered and fabricated into a uniform thickness and density. The thickness and density may be selected to accommodate the needs and desires of the persons having the tennis/sports court/track installed.

The basemat 11 is laid on the existing surface and preferably is secured thereto, for example, glued/-bonded atop the wood or concrete etc. surface being installed 10 or refurbished 10*a*. If tile like sections are used, the sections should be snugly abutted along their edges to substantially avoid gaps or spaces along juxtaposed sides.

Both tile like and roll form basemat are commercially available from DODGE-REGUPOL, INC. having offices in LANCASTER, Pa.

The basemat 11 is selected, empirically or by specification, to provide a customized cushioning or resilience for the particular surface, for example a tennis court or running court or gymnasium, etc. In this manner, substantial protection is provided to avoid back and leg injuries/discomfort/fatigue while utilizing the sport/-tennis court.

It is also noted that polyethylene foam may be used under the "SBR" Basemat on different surfaces (e.g., cinder, asphalt, concrete, wood or the like) as an added shock pad to facilitate the cushioning process.

The primer coat 12 is basically a mixture of two parts of dry silica sand with ten parts of a urethane based type sub-floor and construction adhesive. The primer coat 12 is applied, for example, with a stiff hard rubber squeegee in an amount generally sufficient to fill in or abridge the imperfections or gaps or fissures 21,22 that are typical in the generally available "SBR" basemat.

Although the application of primer coat 12 generally increases the surface tensile power or strength of the basemat, it has been found not to detrimentally affect the flexibility or resiliency of the "SBR" Basemat 12 in accordance with one feature or aspect of the invention.

In this manner, it was discovered that the primer coated basemat 11 was relatively resistant to extreme heat and substantially prevents the sports/tennis surface from becoming sticky. Thus, in accordance with another feature of the invention, a more consistent surface texture is maintained which facilitates the sports activity while providing a relatively safer anti-skid surface.

The primer coat 12 generally makes the basemat 11 substantially waterproof, while having chemical (bonding) compatibility with the "SBR" basemat 11 and the subsequently applied acrylic latex compound(s) 14.

The grip coating 13 is applied over the primer coat 12 while the primer is still wet. The grip coat 13 consists of dry silica sand generally ranging from a minimum of a #100 grit to a #40 grit. The sand is sprayed over the wet primer 12 and left to dry and cure over the following 24 hours or more. A soft brush (not shown) or lower pressure blower (not shown) is typically used to remove any excess (not bonded) sand off the surface area.

The grip (sand) coating becomes an integrally bonded sand layer atop the primer coating 12 and basemat 11, forming a strong and flexible base that is a distinguishing feature over the prior art does not require additional urethane, water or solvent base adhesive or non-woven fabric sheet.

It should be recognized that in many prior art systems or sports surfaces a water base, solvent base or urethane base adhesive is used with a fiber or non-woven fabric in order to obtain a proper bonding to acrylic layers. This results in a process that is relatively expensive, timely and difficult to install. Such surfaces can also become sticky in hot temperatures and are, therefore, relatively dangerous.

The Leveler or filler coating 14 comprises a sand filled acrylic latex compound, which is a none pigmented concentrate. The Leveler coating 14 may be applied with a rubber squeegee.

The Leveler coating 14 mixture may, for example, comprise 30 gallons of acrylic latex, 100 lbs of either #60 grit or #40 grit silica sand and diluted with 15 gallons of water.

The acrylic latex compound is commercially available, for example, from the Koch Asphalt Company which has Offices in Chicago, Ill., and is referred to as "DECOBASE" 920-05.

The leveler coating 14 may be applied with a soft rubber squeegee or wide floor broom, used as a squeegee. The first application preferably should be made parallel to one of the directions of the surface.

Care must be exercised not to leave ridges of coating where adjoining applications overlap.

When the first application or coat has dried, another application may be applied if desired. The following applications should,preferably, be applied at right angle to the proceeding application and left to dry.

The leveler coating 14 provides a finish like surface having excellent toughness and also fills in low spots, and levels minor imperfections.

The texture coating 15 comprises a fine sand filled acrylic latex compound, which may be applied to effect a fine surface texture.

The texture coating 15 is similar to the leveler coating 14 except that, if desired, a fine or smaller grit size silica sand is used.

In this manner, the surface texture may be varied or selected for desired traction and/or ball-on-court response, e.g., bounce and speed variations.

The sports/tennis court is generally coated with several color coatings 16.

In contrast to the prior, another feature of the present invention is that the color coating(s) 16 is applied without mixing the paint or coloring agent with any silica sand ingredient or texture ingredient. In this manner, it has been discovered that the color coated surface is long lasting with relatively little or virtually no surface ware.

Depending on the type of sports field being installed (or repaired), for example, tennis court or track field etc., the appropriate playing lines 17 may be painted on the color coated 16 surface.

METHOD OF REFURBISHING

With reference now to FIG. 2 and 2A, the method of renovating a prior art sports surface/court **10*a*** will now be discussed.

Basically speaking, the renovation comprises the following steps:

- filling in or repairing any cracks 23 or holes 24 in the existing sports surface **10*a*;**
- applying a basemat 11 over the existing surface, said basemat 11 may be secured to the existing surface **10*a* by means of an adhesive, polyethylene foam 30** or other suitable fasteners (not shown);
- applying a primer coat 12 over said basemat 11;
- applying a grip layer 13 over said primer coat 12;
- applying a leveler coat(s) 14 over said grip layer 13;
- applying one or more texture coat(s) 15 over said leveler coat(s) 14; and
- applying one or more color coating(s) 16 over said texture coat 15.

METHOD OF REPAIR

Figure 3:
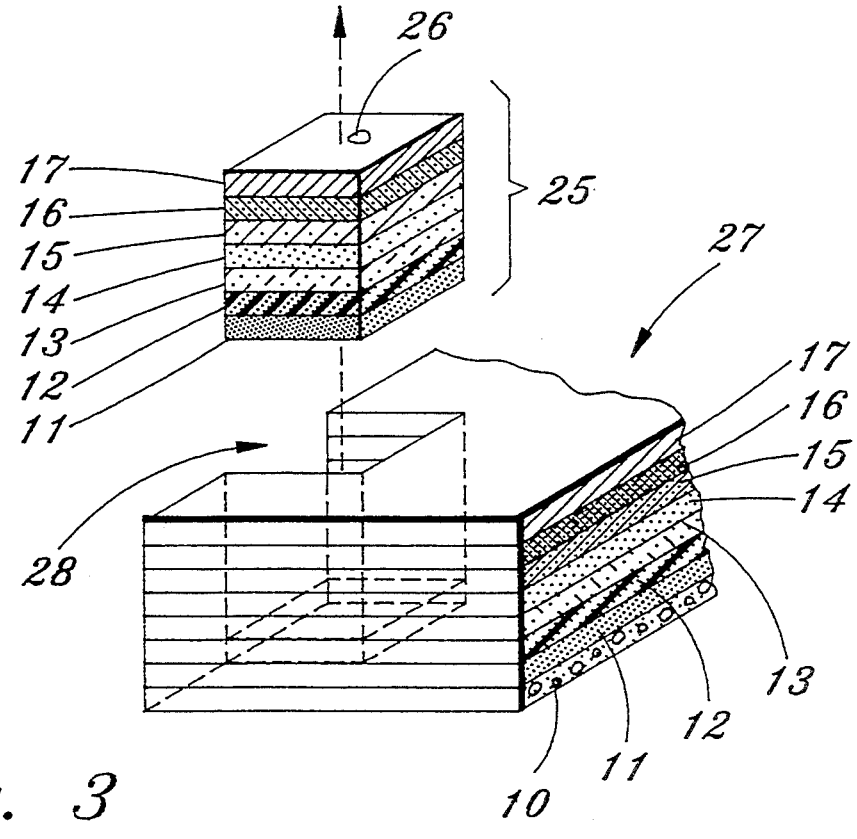
FIGS. 3 and 3A are broken perspective/illustrative views of another preferred embodiment of a method for renovating or refurbishing an existing prior art type sports floor surface in accordance with the invention.
Figure 3A:
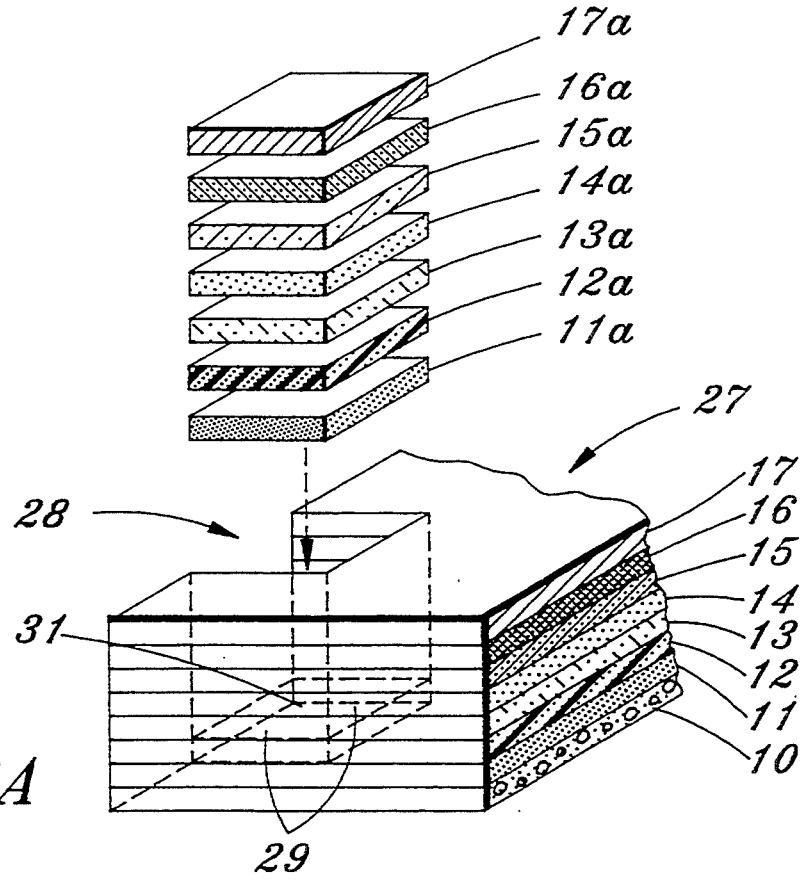

With reference now to FIG. 3 and 3A, the method of repairing a sports/tennis surface 27 which was installed in accordance with the present invention, consisting of the following steps:

- cutting out and removing the damaged section 25 of the sports surface 27;
- applying an adhesive 30 over the exposed subsurface 31;
- installing a section of basemat **11*a* dimensioned to fit snugly within the cut-out area 28**;
- applying a primer coat **12*a* over the basemat 11*a* and filling any gaps between said basemat section 11*a* and the juxtaposed surfaces 29 of the existing court 27**;
- applying a grip layer **13*a* over said primer coat 12*a*;**
- applying one or more leveler coatings **14*a* over said grip layer 13*a*;**
- applying one or more texture coatings **15*a* over said leveler coat 14*a*;**
- applying one or more color coatings **16*a* over at least said leveler coating 14*a* and/or over a larger (or entire) portion of the sports/tennis surface 27**;
- applying/restoring the desired sports playing lines **17*a* on the appropriate portions of the sports surface 27**.

Thus in accordance with the invention, the present invention provides a new and improved sports/tennis surface (court) which enables relatively inexpensive installation and repair.

It is to be understood that the above described arrangements are illustrative of the application of the principles of the invention. Other arrangements may be devised by those skilled in the art without departing from the spirit and scope of the invention.

What is claimed is:

1. A flexible, anti-skid sports surface installed over an existing support surfaced in combination comprising:

- a prefabricated basemat secured to the support surface;

a primer layer consisting of a mixture of sand and a urethane based adhesive applied over and adhered to a portion of said basemat;

a grip layer consisting of sand applied over and adhered to said primer layer;

a leveling/texture layer consisting of a sand filled acrylic latex compound applied over and adhered to said grip layer;

a color/paint layer applied over and adhered to said leveling/texture layer.

2. A sports surface as in claim 1, wherein:

the basemat being formed of rubber particles are bound together with a polyurethane adhesive.

3. A sports surface as in claim 2, wherein:

the basemat is in roll or tile like sections.

4. A sports surface as in claim 1, wherein:

the primer layer is a mixture of two parts dry silica sand with ten parts of a urethane based type subfloor and construction adhesive applied to fill-in any fissures in said basemat and provide a substantially water proof coating over said basemat.

5. A sports surface as in claim 1, wherein:

the grip layer is applied over said primer layer while still wet and consists of a dry silica sand generally ranging between a #100 grit and a #40 grit.

6. A sports surface as in claim 1, wherein:

the leveling/texture layer comprises a dry silica sand having a selected grit rating of very fine to coarse.

7. A cushioned laminated tennis court surface, comprising:

a substructure (10);

a basemat (11) affixed to said substructure and having a predetermined thickness and flexibility and resilience;

a first primer layer (12) comprising a urethane adhesive and a dry silica sand of predetermined grit size placed over said basemat and adhered thereto;

a second layer (13) consisting of a dry silica sand having a selected grit size placed over and adhered to said first layer without requiring or use of any additional urethane, water or solvent base adhesive or non-woven fabric to provide a relatively strong and flexible basemat;

a third layer (14) comprising a relatively coarse grit sand filled acrylic compound placed over and adhered to said second layer;

a fourth layer (15) comprising a relatively fine grit sand filled acrylic compound placed over and adhered to said third layer;

a fifth layer (16) of paint placed over and adhered to said fourth layer,without mixing with or use of additional sand or texture ingredient therewith;

a sixth layer (17) of paint placed over and adhered to selected portions of said fifth layer to form playing court lines;

whereby a relatively inexpensive, easy to maintain and repair, waterproof, anti-skid, customized cushioned, and longer lasting tennis court is obtained.

8. A tennis court as in claim 7, wherein:

the basemat (10) is adhered to said substructure 10 by means of a polyethylene foam or adhesive (30).

* * * * *